US007029558B2

(12) United States Patent
Tomonaga et al.

(10) Patent No.: US 7,029,558 B2
(45) Date of Patent: Apr. 18, 2006

(54) TITANIUM-MADE CATHODE ELECTRODE FOR PRODUCING ELECTROLYTIC COPPER FOIL, ROTARY CATHODE DRUM USING THE TITANIUM-MADE CATHODE ELECTRODE, METHOD OF PRODUCING TITANIUM MATERIAL USING TITANIUM-MADE CATHODE ELECTRODE AND METHOD OF CORRECTING/WORKING TITANIUM MATERIAL FOR TITANIUM-MADE CATHODE ELECTRODE

(75) Inventors: Sakiko Tomonaga, Ageo (JP); Satoru Fujita, Ageo (JP); Hiroshi Tanaka, Joetsu (JP); Yutaka Kiminami, Joetsu (JP); Isamu Kanekatsu, Joetsu (JP); Atsuhiko Kuroda, Osaka (JP)

(73) Assignees: Mitsui Mining & Smelting Co., LTD, Tokyo (JP); Nippon Stainless Steel Kozai Co., LTD, Nigata (JP); Sumitomo Metal Industries, LTD, Osaka (JP)

( * ) Notice: Subject to any disclaimer, the term of this patent is extended or adjusted under 35 U.S.C. 154(b) by 512 days.

(21) Appl. No.: 10/203,472

(22) PCT Filed: Dec. 26, 2001

(86) PCT No.: PCT/JP01/11424

§ 371 (c)(1),
(2), (4) Date: Aug. 12, 2002

(87) PCT Pub. No.: WO02/053805

PCT Pub. Date: Jul. 11, 2002

(65) Prior Publication Data

US 2003/0116241 A1 Jun. 26, 2003

(30) Foreign Application Priority Data

Dec. 27, 2000 (JP) ..... 2000-397481

(51) Int. Cl.
*C25B 11/04* (2006.01)

(52) U.S. Cl. ..... 204/292; 204/212; 204/213; 148/669; 148/670; 148/421

(58) Field of Classification Search ..... 204/292, 204/212, 213; 148/669, 670, 421
See application file for complete search history.

(56) References Cited

U.S. PATENT DOCUMENTS 6,544,663 B1 * 4/2003 Nakano et al. ..... 428/606

FOREIGN PATENT DOCUMENTS

| | | |
|---|---|---|
| JP | 4-36488 | 2/1992 |
| JP | 8-144033 | 6/1996 |
| JP | 8-225905 | 9/1996 |
| JP | 9-176809 | 7/1997 |

* cited by examiner

*Primary Examiner*—Bruce F. Bell
(74) *Attorney, Agent, or Firm*—Rothwell, Figg, Ernst & Manbeck, P.C.

(57) ABSTRACT

The purpose is to provide a cathode electrode for manufacturing an electrodeposited copper foil which is possible to be continuously and stably usable for a long duration of 3000 hours or longer to subsequently lessen the frequency of maintenance work execution as low as possible and to contribute to lower the running cost of the electrodeposited copper foil manufacture. As the means for achieving the purpose, a cathode electrode made of a titanium material is employed for obtaining an electrodeposited copper foil using an electrolytic copper solution and the titanium material having 7.0 or higher crystal grain size number and 35 ppm or lower initial hydrogen content is used for manufacturing the cathode electrode for manufacturing an electrodeposited copper foil. Further, also provided is a manufacturing method of the titanium material to be employed for the cathode electrode made of a titanium material.

5 Claims, 5 Drawing Sheets

A pit generated in the surface of a titanium electrode after use for electrolysis (a) A precipitate filtered in the case of using A material.

(b) A precipitate filtered in the case of using B material.

TITANIUM-MADE CATHODE ELECTRODE FOR PRODUCING ELECTROLYTIC COPPER FOIL, ROTARY CATHODE DRUM USING THE TITANIUM-MADE CATHODE ELECTRODE, METHOD OF PRODUCING TITANIUM MATERIAL USING TITANIUM-MADE CATHODE ELECTRODE AND METHOD OF CORRECTING/WORKING TITANIUM MATERIAL FOR TITANIUM-MADE CATHODE ELECTRODE

FIELD OF THE INVENTION

The present invention relates to a cathode electrode made of titanium for manufacturing electrodeposited copper foils, a manufacturing method and a correcting method of a titanium material to be used for the cathode electrode made of titanium.

PRIOR ART

Conventionally, a cathode electrode made of titanium has been employed for manufacturing an electrodeposited copper foil. That is because a titanium material has a sufficiently stable acid resistant capability even to a strongly acidic solution such as a copper sulfate solution to be employed for manufacturing an electrodeposited copper foil and is easy to be handled as a cathode electrode owing to remarkably light weight as compared with a stainless steel or the like and easy to peel and separate the electrodeposited copper foil from.

It is rational to require a cathode electrode made of titanium in a case of manufacturing the electrodeposited copper foil to be stable for manufacturing an electrodeposited copper foil for a long duration. Especially, since the electrodeposited copper foil is obtained by peeling copper deposited in a foil state on the cathode electrode, one side of the obtained electrodeposited copper foil has a mirror shape of the cathode electrode and this side is generally called as a shiny side. Incidentally, the other side is matte having considerable unevenness as compared with the shiny side and for that generally the face is called a matte side.

The surface shape of the shiny side is to be kept even if the surface treatment is carried out and the electrodeposited copper foil is used for manufacturing a printed circuit board and remains as the electrodeposited copper foil as a final product. For example, after a copper-laminated plate is produced by laminating a copper foil to a substrate resin, the shiny side is to be coated with an etching resist layer for manufacturing a printed circuit substrate and to be the face where an etching circuit pattern is produced. At that time, depending on the micro shape of the shiny side, an excellent adhesion property to the etching resist layer cannot be provided, sometimes resulting in occurrence of the inferior finishing precision of the etching circuit.

Due to that, in an actual electrodeposited copper foil manufacturing field, a titanium material excellent in acid resistance has been employed for the cathode electrode at the time of manufacturing an electrodeposited copper foil as a material which is changed and denatured as scarcely as possible in the shape of the cathode electrode surface even in a strongly acidic copper electrolyte.

However, actually, even if a titanium material excellent in acid resistance is employed for a cathode electrode, during the use for a long time, a phenomenon takes place that the surface state of the titanium material to electrodeposit copper thereon is changed with the lapse of time of electricity communication to make the surface roughened.

If the surface state of a cathode electrode made of titanium is roughened, the shiny side of an electrodeposited copper foil, which may be said a mirror shape of the cathode electrode made of titanium, is naturally roughened. Further, as a electrodeposited copper foil becomes thinner, the possibility to be employed for formation of a fine pitch circuit is high and the shiny side is required to be a face with no abnormality. FIG. 1 shows the surface condition of a cathode electrode made of titanium to be employed for manufacturing of an electrodeposited copper foil. FIG. 1 shows the surface of the cathode electrode made of titanium observed by an optical microscope, points where the focal depth seems different are observed in the surface, so that it can be understood the surface of the cathode electrode made of titanium becomes convexoconcave. The convex and concave points are slight dents called as pits in this specification and are not observed in the surface of the cathode electrode made of titanium before it is employed for manufacturing the electrodeposited copper foil. The principle of the pit formation has been thought for a long as mainly due to corrosion of the titanium material in the same manner as in the case of an iron and steel material. If the cathode electrode made of titanium is employed for manufacturing an electrodeposited copper foil while pits existing in the surface of the electrode, extremely small projections are formed or precipitation abnormality occurs in the shiny side of the electrodeposited copper foil in the points corresponding to the pits and in the case where a fine pattern circuit is to be formed by a further thinner etching resist layer is formed using so-called liquid resist, excellent registration becomes impossible. For example, it becomes problems in the case where such an electrodeposited copper foil is employed for TAB (tape automated bonding) or for a rigid type printed circuit substrate with a wiring density of so-called 5 or more between pins.

For that, in practical manufacture of an electrodeposited copper foil, the roughness of a manufactured shiny side of the electrodeposited copper foil is measured and if the value of the shiny side roughness is out of a control value, it is general that the surface of a cathode electrode made of titanium is subjected to maintenance work for adjusting the convexoconcave state of the surface by grinding the surface to repeatedly use the electrode. In such a case, the continuously usable duration of a conventional cathode electrode made of titanium has been in a wide range of dispersion and from an experiential view, it has been about 340 to 2900 hours.

Moreover, the grinding of a cathode electrode made of titanium to be employed for manufacturing an electrodeposited copper foil is difficult to be made full-automated and it requires a worker to have extremely high skilled level. From a viewpoint of such circumstances, these facts results in increase of the maintenance cost of a cathode electrode made of titanium employed for manufacturing an electrodeposited copper foil and consequently results in increase of the running cost of electrodeposited copper foil manufacture as a whole.

Because of those reasons, it has been expected to make a cathode electrode available for long which is possible to be continuously and stably usable for a long duration of 3000 hours or longer to subsequently lessen the frequency of maintenance work execution as low as possible and to contribute to lower the running cost of the electrodeposited copper foil manufacture and which is thus possible to provide an economical and high quality and thin electrodeposited copper foil.

SUMMARY OF THE INVENTION

Figure 1:
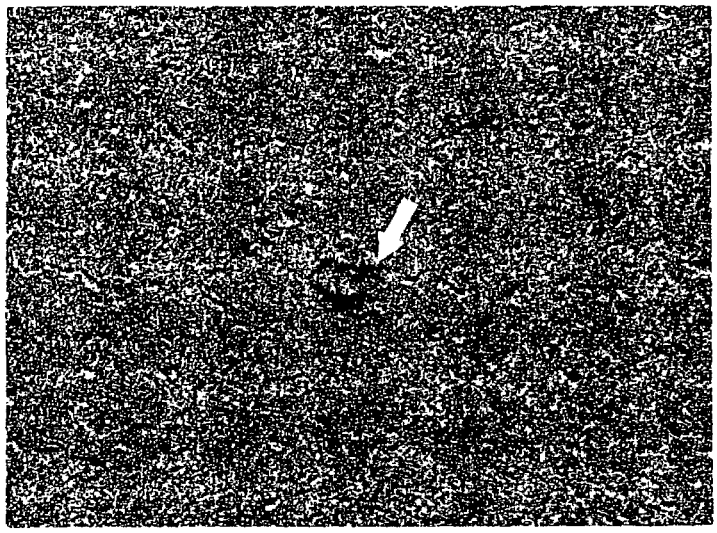
FIG. 1 shows a surface condition of a cathode electrode made of titanium.

Inventors of the invention have enthusiastically made investigations and come into conclusion it is possible to make a cathode electrode made of titanium as described below usable for a remarkably long duration for electrodeposited copper foil manufacture, to lower the frequency of the maintenance work, and manufacture a high quality electrodeposited copper foil for a long duration as compared with a conventional one. Further, inventors of the invention complete a manufacturing method suitable for manufacturing a titanium material to be employed for a cathode electrode made of titanium referred above. Hereinafter, the inventions will be described.

Described in the claims is a titanium cathode electrode made of a titanium material to be employed for obtaining an electrodeposited copper foil using a copper electrolyte, wherein the titanium material has 7.0 or higher grain size number and 35 ppm or lower initial hydrogen content to be employed for a cathode electrode made of titanium for manufacturing an electrodeposited copper foil. The following are background of the achievement of this invention.

At first, inventors of the invention try to confirm whether it is true or not that the pits caused in the surface of a cathode electrode made of titanium are attributed simply to corrosion by an electrolyte, which has been recognized as it is. For that, inventors of the invention at first carry out analysis of dent-like pit parts observed in the surface of a titanium material of a cathode electrode made of titanium employed for manufacturing an electrodeposited copper foil. As a results, titanium hydride is detected in dent parts of pits by the analysis of the pit parts by an x-ray diffraction analyzer for an extremely narrow region. Owing to that, it can be judged that titanium hydride exists in the pit parts Further, in a shiny side of an electrodeposited copper foil, which is a mirror shape of a titanium material employed as the cathode electrode, it is also confirmed that even though an extremely small amount, titanium is detected in the surface of a copper foil in the parts corresponding to the transferred parts of pits observed in the cathode electrode made of titanium. That the trace of the cathode electrode remains on the surface of an electrodeposited copper foil as descried above can be supposed to be a particular phenomenon for the manufacturing method in which an electrodeposited copper foil is obtained by depositing a copper foil on the surface of a titanium material of a cathode electrode made of titanium and peeling the copper foil. These facts lead to judgment that it is highly possible that the formation of pits of a cathode electrode made of titanium employed for manufacturing an electrodeposited copper foil is not attributed simply to corrosion of a titanium material by an electrolyte but attributed to formation of titanium hydride by absorption of hydrogen during copper electrolysis and dropping of the grown titanium hydride.

Owing to that, inventors of the invention compare the formation speeds of titanium hydride using a titanium material (hereinafter referred as to A material) used for a cathode electrode possible to be used continuously for about 5 months in manufacture of a 18 μm-thick electrodeposited copper foil and a titanium material (hereinafter referred as to B material) used for a cathode electrode possible to be used continuously for about 1 month, that is, the comparison is carried out by trying hydrogen introduction into a titanium material as an acceleration test by evolving hydrogen using these respective titanium materials as cathode electrodes in a solution containing 180 g/l of $Na_2SO_4$ (dehydrated) and 150 g/l of $H_2SO_4$ in a beaker in the conditions of 50 mA/cm$^2$ current density, a room temperature as the solution temperature, and 168 hours for electric power communication. In this case, since hydrogen evolution amounts of both cases supposedly depend on the electric power applied, the electric power applied is regarded to be same.

Figure 2:
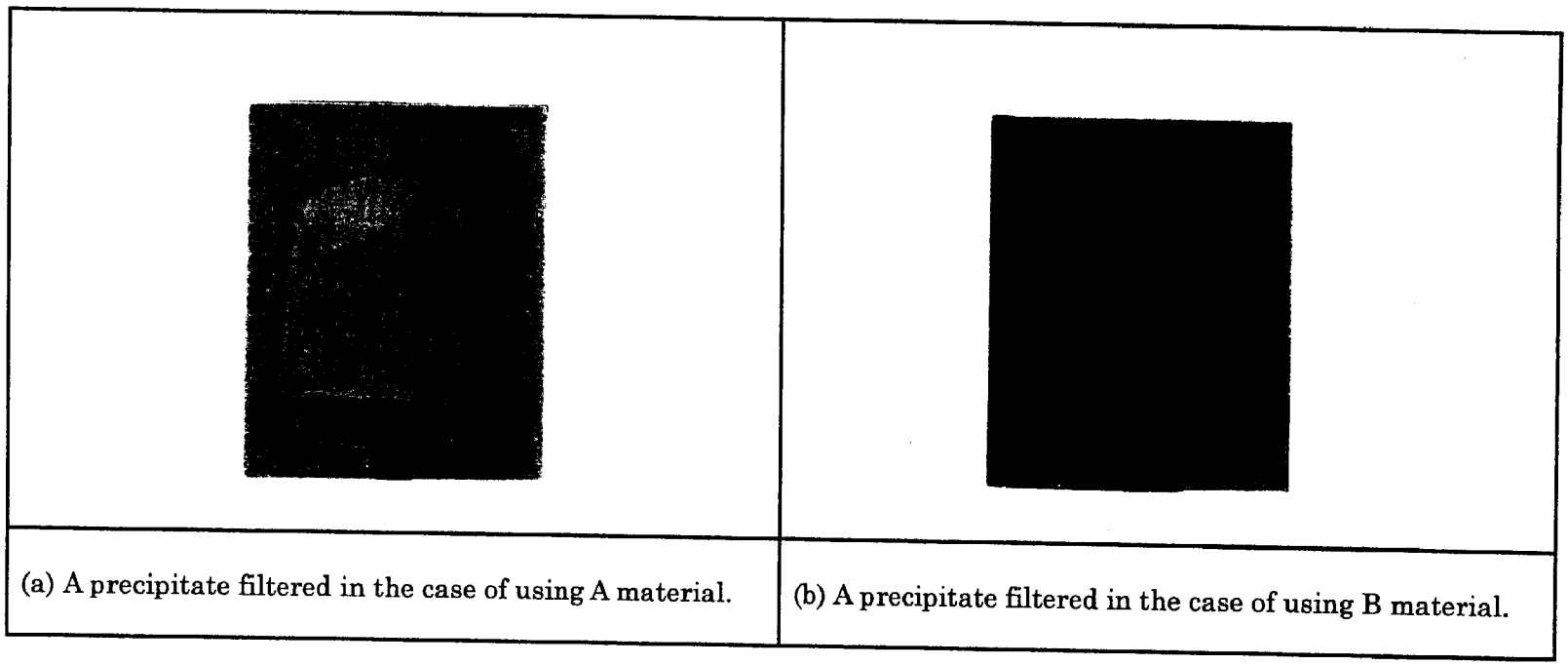
FIG. 2 shows a photograph of a sheet of filter paper used for filtration of black foreign substances precipitated in a beaker in a hydrogen absorption experiment.

During the experiments, inventors of the invention have found that precipitation of foreign substances seen black is observed in the bottom part of the beaker on completion of electric power application. Then, the black foreign substances are collected by filtration paper and it is found that the amount of the precipitated foreign substances is more in the case of the foregoing material B than the foregoing material A. FIG. 2 shows that. The analysis of the precipitated foreign substances by electron diffraction using a transmission electron microscope makes it clear that the substances are titanium hydride. Consequently, in judgment from the results of the hydrogen introduction experiment, it is supposed to be possible that the similar phenomenon takes place at the time of manufacturing an electrodeposited copper foil in a cathode electrode made of titanium to be employed in manufacture of an electrodeposited copper foil.

Taking the facts described above into consideration, it can be understood that it is indispensable to suppress the growth of titanium hydride as much as possible and to keep the surface smooth of a cathode electrode made of titanium in order to improve the product quality of an electrodeposited copper foil. Consequently, inventors of the invention assume the cause of the change of the surface state in manufacture of an electrodeposited copper foil using a cathode electrode made of titanium with the lapse of time is attributed to the change of the surface state of the cathode electrode made of titanium by absorption of hydrogen in the cathode electrode made of titanium at the time of electrolysis, successive formation of titanium hydride in the crystal structure, generation of deformation and strain of crystal lattice owing of the proceeding of titanium hydride and occurrence of dropping of the formed titanium hydride.

Further, in consideration of the contrast of the foregoing A material and the foregoing B material, in the initial component analysis, the contents of oxygen, nitrogen, carbon, iron, hydrogen and the like are approximately same respectively and the different point of these materials is in the crystal grain. The crystal grain of the A material is equivalent to that defined as crystal grain size no. 7.1 and the crystal grain of the B material is equivalent to that defined as crystal grain size no. 5.6 and the crystal grain of the A material is finer. Consequently, in this stage, inventors of the invention judge that,the formation of titanium hydride can probably be suppressed more as the crystal grain is finer.

Incidentally, "the crystal grain number" can be judged from the crystal structure photograph of a titanium material and the judgment of the crystal grain is performed by a cutting method and the given number is that measured based on the standard employed for the ferrite crystal grain size testing method for a steel defined as JIS G 0552 and the crystal grain number is calculated by observing the crystal grains magnified by 100 time magnification, counting the average number of the crystal grains in 25 mm square, and converting the number into the crystal grain number. The conversion equation is shown as a formula 1 below.

$$\text{Grain number}=(\text{Log } n/0.301)+1 \quad \text{[Formula 1]}$$

wherein, n denotes the number of crystal grains in 25 mm square by 100 time magnification of a microscope.

Further, the hydrogen contents in the A material and the B material after hydrogen absorption in a beaker are investigated to find that the hydrogen content is 580 ppm for the A material and 560 ppm for the B material although the initial hydrogen amounts are 37 ppm in both materials and if it is assumed that the foregoing black precipitates in a beaker is titanium hydride and that the amount of the precipitate is more in the case of the B material, the hydrogen absorption amounts can be said to be approximately the same without any objection.

With consideration of this result, it can be assumed that the larger crystal grain size number or the smaller grain size the titanium material has, the less easy formation of titanium hydride or the less easy dropping of formed titanium hydride is provided.

Conventionally, in a practical industrial electrolysis for manufacturing an electrodeposited copper foil, a copper sulfate solution or the like at around 50° C. is used as an electrolyte and the solution is circulated at a high speed so as not to cause copper ion depletion in the periphery of the cathode electrode and an electrodeposited copper foil is manufactured at a considerably high electric current density as compared with the electric current density employed for a common simple plating process. Although it is difficult to confirm in a laboratory, if those conditions are satisfied, the electrolysis efficiency closed to approximately 100% can seemingly be achieved based on the Coulomb's raw to in relation to the supplied electricity amount. As a result, the recognition has to be disproved that the spontaneous hydrogen absorption in a cathode electrode made of titanium to be employed for manufacturing an electrodeposited copper foil is inevitable and the effect of hydrogen absorption on the cathode electrode made of titanium is too slight to result in a problem.

As a result of the above-described experiments and verifications, inventors of the invention discuss from two sides: (1) establishment of a method for remarkably lowering the hydrogen absorption of a titanium material of a cathode electrode made of titanium and (2) investigation of a titanium material with scare change in the surface state even if the titanium material of a cathode electrode made of titanium absorbs hydrogen and titanium hydride is formed for the purpose of suppressing the effect of titanium hydride formation on the crystal structure of the cathode electrode made of titanium even if it is impossible to completely prevent hydrogen absorption in the cathode electrode made of titanium, as a measure to remarkably prolong the time of possible continuous use of the cathode electrode made of titanium.

At first, in the case of the former object to establish a method for remarkably decreasing the hydrogen absorption, it can be supposed to lower the hydrogen evolution amount at the time of electrolysis. In order to achieve the object, theoretically, assuming that a titanium material is used for a cathode electrode and if the material for an anode electrode is changed to lower the Tafel's inclination of the polarization curve of hydrogen relatively to the Tafel's inclination of the polarization curve of copper more than the present level, it contributes decrease of electric quantity relating to hydrogen generation and thus hydrogen generation can be suppressed. However, in consideration of those usable as a material having high corrosion resistance in a strongly acidic copper sulfate solution around 50° C. and easy to be processed corresponding to the shape of an electrolytic apparatus, the range of the option is considerably restricted. For that, it is seemingly difficult to solve in the present technical level and in this specification, such means is therefore not to be pursued.

Consequently, it is determined to pursue the investigation of a titanium material with scarce change in the surface state even if titanium hydride is formed owing to absorption of hydrogen on a titanium material of a cathode electrode made of titanium. At first inventors of the invention have investigated to know how much hydrogen a titanium material of a cathode electrode made of titanium necessary to be ground contains. As a result, it has been found that the hydrogen content is not necessarily constant in a titanium material of a cathode electrode made of titanium with which an electrodeposited copper foil is produced with the roughness of the shiny side exceeding the control value.

From such a fact, it can be judged that the hydrogen content is not a single factor to determine the continuously usable time in the electrolytic process for an electrodeposited copper foil with a titanium material of a cathode electrode made of titanium. Therefore, inventors of the invention have discuss through which passage hydrogen generated in the cathode side at the time of electrolysis is taken in a titanium material. Most of hydrogen generated in the cathode side is released to atmospheric air as hydrogen gas and some of hydrogen is taken in the crystal structure of a titanium material. At that time, hydrogen is diffused in the titanium material. The diffusion state is supposed to be classified to either grain boundary diffusion in which diffusion occurs in grain boundaries or intergranular diffusion in which diffusion occurs in the crystal grains.

However, even taking it in consideration that hydrogen atom is rather much small as compared with titanium, the grain boundary diffusion is dominant to the intergranular diffusion based on the easiness of the diffusion. Consequently, even in the crystal structure of a titanium material composing a cathode electrode made of titanium, hydrogen is diffused in the titanium grain boundaries and titanium hydride is supposed to be formed from the grain boundaries as a base point and titanium hydride is grown. The general titanium hydride has a needle-like shape and longer one is found exceeding 100 μm.

Further, regarding the titanium hydride of a titanium material of a cathode electrode made of titanium to be employed for manufacturing an electrodeposited copper foil, it is supposed that the needle-like titanium hydride is grown based on the mechanism of gradually thickening with the proceeding of hydrogen absorption, overlapping and becoming agglomerates and finally dropping from the surface to form pits in the surface of the titanium material, which is a cathode electrode.

The cause of the overlapping of titanium hydride in the form of agglomerates can be thought as follows. Hydrogen which comes in a cathode electrode made of titanium through crystal grain boundaries as diffusion passages forms titanium hydride in a crystal grain boundary as a base point in a certain depth. The titanium hydride is grown by hydrogen further entering by diffusion and finally clogs the crystal grain boundary as the hydrogen diffusion passage. When such a state is formed once, if hydrogen is to be diffused to further deep depth of the cathode electrode made of titanium, hydrogen has to be diffused in the titanium hydride clogging the grain boundary and enter in the inside. However, hydrogen in form of titanium hydride is supposed to occupy the position in the titanium crystal lattice in interstitial state, so that as compared with in a common titanium material, it is general to suppose the diffusion of hydrogen is extremely retarded. In such a state, hydrogen concentration is increased in parts shallower than the existing positions of the titanium hydride grown while clogging the crystal grain boundaries at a certain depth of the crystal structure of the cathode electrode made of titanium and formation of titanium hydride occurs in the shallower parts prior to the other. As a result, the formation speed of titanium hydride is supposed to be accelerated in the proximity of the surface of the cathode electrode made of titanium to grow and accumulated titanium hydride and titanium hydride consequently becomes hard and fragile agglomerates. As a result, it is supposed the agglomerates finally drop from the surface of the cathode electrode made of titanium.

Such consideration as described above can well be conformed to the results of the acceleration experiments of hydrogen absorption described above. Inventors of the invention therefore assume as follows, the current density at the time of manufacturing an electrodeposited copper foil is constant all the time and the hydrogen amount evolved in the cathode side and the hydrogen amount absorbed in a titanium material are constant. Then, if some of the evolved hydrogen is diffused through the crystal grain boundaries of a titanium material and titanium hydride is grown in the crystal grain boundaries as starting points, the grown of the titanium hydride can be said to be retarded by decreasing the hydrogen amount passing the crystal grain boundaries per unit time.

Consequently, if the hydrogen amount to be absorbed in a titanium material is constant, the higher the existence density of the crystal grain boundaries is, that is, the more fine crystal grains exist and the higher the crystal grain size is, the less the amount of hydrogen passing the grain boundaries per unit time becomes. In other words, it can be said that a titanium material having a finer crystal size has a higher crystal grain density, so that the grain boundaries to be hydrogen diffusion passages exist more and the hydrogen amount passing through the respective crystal grain boundaries is lessened more and growth of a titanium hydride as to clog the crystal grain boundaries, which are hydrogen diffusion passages, can be suppressed. On the contrary, since the crystal grain density is lower as the crystal grain of a titanium material of a cathode electrode made of titanium is bigger and the crystal grain size is smaller, it can be said that the grain boundaries to be hydrogen diffusion passages are a few and hydrogen amount passing in the respective crystal grain boundaries is increased to accelerate the formation and growth of titanium hydride formation in the crystal grain boundaries as starting point in the proximity of the surface of a cathode electrode.

Based on the above-described consideration, inventors of the invention have investigated a cathode electrode made of titanium in which pits are generated, a cathode electrode made of titanium in which no pits are generated, and crystal grain boundaries and hydrogen contents of the respective cathodes. Table 1 shows the results. In the experiments, titanium plates used contain about 18 to 20 ppm of hydrogen content as an initial hydrogen content. Using the titanium plates, while copper foils being manufactured by precipitating copper on the surface in a copper sulfate solution and peeling the precipitated copper, the generation of pits is confirmed. The experiment is carried out using a copper sulfate solution containing 65 g/l of copper and a lead plate as an anode at 40 A/dm$^2$ of current density for 3,000 hours of electrolysis duration in total and at 48° C. of a solution temperature. The lead anode is employed in this case because the electrolysis conditions for an electrodeposited copper foil are controlled to be as similar as possible to general manufacturing conditions and therefore an electrode employed practically is employed. The total electrolysis duration described above does not mean the duration in which completely continuous copper electrolysis is carried out because of a laboratory experiment but means the practical electrolysis duration owing to the existence of discontinuous duration for electrolyte renewal in time to time. In this specification, the measurement of the hydrogen content (amount) in a titanium material is carried out according to JIS H 1619 to employed the obtained value as the amount.

TABLE 1

| | | | Hydrogen content after electrolysis (ppm) | | | |
|---|---|---|---|---|---|---|
| Sample No. | Crystal grain size No. | Initial hydrogen content (ppm) | Surface hydrogen content | Total hydrogen content | Occurrence of pits 1,000 hours | Occurrence of pits 3,000 hours |
| 1 | 5.5 | 20 | 32 | 25 | Observed | Observed |
| 2 | 5.9 | 19 | 33 | 24 | | |
| 3 | 6.7 | 20 | 33 | 25 | Not | |
| 4 | 7.0 | 20 | 32 | 24 | observed | Not |
| 5 | 7.1 | 18 | 33 | 25 | | observed |
| 6 | 7.3 | 19 | 33 | 25 | | |
| 7 | 7.5 | 19 | 33 | 24 | | |
| 8 | 7.8 | 20 | 33 | 25 | | |

As being made clear from Table 1, if the initial hydrogen content before used as a cathode electrode is at the same level, not so significant difference is observed in the hydrogen content after electrolysis for a prescribed duration. In Table 1, "the surface hydrogen content" after electrolysis is defined as the hydrogen content measured by cutting a 1.5 mm-thick sample from the surface of a titanium material employed as a cathode electrode on completion of electrolysis for 3,000 hours in total of electrolysis duration and "the total hydrogen amount" is defined as a value measured in the entire titanium material. Consequently, if the absorbed hydrogen amount is approximately same, as it is made clear based on the occurrence of the pits, it can be supposed that pit generation tends to be more difficult as the value of the crystal grain size number, which is an index of the crystal grain size, is higher. That is, no pit generation is observed in samples with 6.7 or higher crystal grain size number after 1000 hours of the total electrolysis duration. On the other hand, pit generation is observed even in sampled with 6.7 crystal grain size number after 3000 hours of the total electrolysis duration and no pit generation is observed in samples with 7.0 or higher crystal grain size number. Further, in the case of samples with crystal grain size number of 7.5 or higher, no pit generation is observed even if the total electrolysis time exceeds 5000 hours. According to the above-described facts, it is supposed to be the minimum necessary condition that the crystal grain size number is 7.0 or higher, preferably 7.5 or higher, in order to prevent pit generation in a titanium material.

Next, inventors of the invention have made investigations of the effect of the initial hydrogen content on the pit generation when the crystal grain size number is adjusted approximately at the same level, and Table 2 shows the results. The samples employed in this case all have crystal grain size number of 7.0 to 7.1 and the initial hydrogen contents of 20 to 40 ppm. The conditions employed for the electrolysis conditions or the like are same as those in the experiment as shown in Table 1.

TABLE 2

| Sample No. | Crystal grain size No. | Initial hydrogen content (ppm) | Hydrogen content after electrolysis (ppm) Surface hydrogen content | Total hydrogen content | Occurrence of pits after 3000 hours |
|---|---|---|---|---|---|
| 1 | 7.0 | 20 | 33 | 25 | Not observed |
| 2 | 7.0 | 24 | 35 | 29 | |
| 3 | 7.1 | 27 | 39 | 31 | |
| 4 | 7.0 | 31 | 41 | 34 | |
| 5 | 7.1 | 35 | 46 | 38 | |
| 6 | 7.1 | 38 | 50 | 44 | Observed |
| 7 | 7.0 | 40 | 53 | 45 | |

As being made clear from Table 2, if the crystal grain size is approximately at the same level, linear correlation is observed in the correlation between the initial hydrogen content and the hydrogen content after electrolysis. That is, although it can be considered easily, those in which no pit generation is observed are restricted to samples with 35 ppm of initial hydrogen content or lower in consideration of the occurrence of pit generation after 3000 hours in total of the electrolysis, and taking the fact in consideration, it can be said that a titanium material to be employed as a cathode electrode has to satisfy the condition that the initial hydrogen content is 35 ppm.

As it is understood from the results shown in Table 1 and Table 2, in regions of 7.0 of crystal grain size or bigger and of 35 ppm of hydrogen content or lower, it is made possible to carry out stable and continuous manufacture of an electrodeposited copper foil for 3000 hours or long in total of the electrolysis. Among the regions of crystal grain size of 7.5 or bigger and of 20 ppm of hydrogen content or lower, further stabler and continuous manufacture of an electrodeposited copper foil is made possible and stable operation for 5000 hours in total of electrolysis is found possible. Incidentally, similar results are obtained in the case where DSA anode, which is a dimention stable electrode generally called as Permelec electrode, as an anode electrode and an insoluble anode as same as a lead anode, is used as the anode electrode.

Consequently, these phenomena are supposed to show similarly tendency even in the case of actual manufacture of an electrodeposited copper foil. Base on such a consideration, the invention as claimed in claim 1 is achieved. As described above, taking the crystal grain size and the hydrogen content into consideration, the life of a titanium material employed as a cathode electrode can be prolonged, however there exists dispersion to a certain extent in the possible duration of continuous use.

Then, according to the results of the investigation which inventors of the invention have performed, hydrogen absorption is found accelerated if there exist so-called twin in the crystal structure in the surface of a cathode electrode made of titanium. Consequently, even if a titanium material with the same levels of the crystal grain size and the hydrogen content exists, it is supposedly possible that the difference of the existence ratio of the twin contained in respective crystal structures affects the continuously usable duration. The twin means the existence of the crystal structure mirror symmetric on the twin boundaries (faces). As compared with general crystal grain boundaries, the twin boundaries are in the state where the lattice points are simply shifted and have certain regular lattice strain, so that the twin boundaries are supposed to be in a low energy state. For that, as compared with general crystal grain boundaries with which atom arrangement becomes irregular, hydrogen easily enters in the lattice of the twin boundaries and diffusion passages are seemed easy to be formed, it can be supposed that the twin boundaries become sites where titanium hydride formation takes place prior to the other. In such a consideration, as a cathode electrode made of titanium for manufacturing an electrodeposited copper foil, it is supposed that as the existence ratio of the twin is lower, the hydrogen absorption is retarded more and the growth of titanium hydride can be retarded more.

Figure 3:
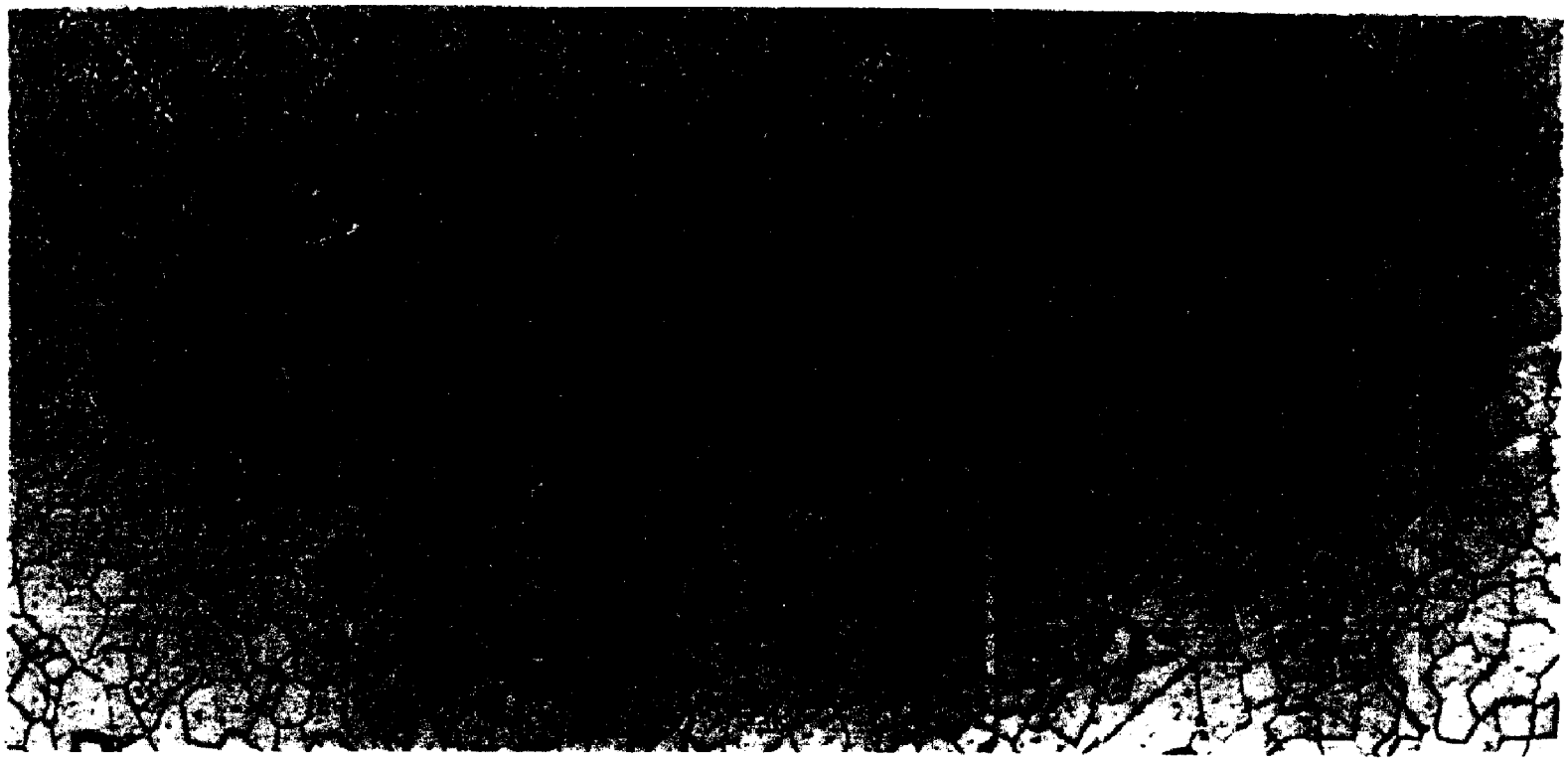
FIG. 3 shows a crystalline structure of a titanium material in which a hydride is formed.

According to the above description, the invention claimed includes a cathode electrode made of titanium for manufacturing an electrodeposited copper foil according to the invention is a cathode electrode made of titanium for manufacturing an electrodeposited copper foil in which the existence of twin in the crystal structure of a titanium material is restricted to 20% or lower. The inventors of the invention have made investigation to find from which position titanium hydride is generated in a titanium material where twin exists. A titanium material used as a cathode electrode made of titanium for practically manufacturing an electrodeposited copper foil is cut and the crystal structure photograph observed in the region of 1.5 mm depth from the surface layer of the titanium material is shown in FIG. 3. In FIG. 3, the twin boundary faces are points where the crystal grains can be observed to be linear and needle-like and titanium hydride can be observed as fine black points. Consequently, as it can be understood from FIG. 3, the state that titanium hydride is dispersed in the crystal structure can be observed. However, according to the observation along the twin boundary faces, titanium hydride is found generated along the twin boundary faces. According to these facts, hydrogen is easy to enter in the twin boundaries and the twin boundaries are supposed to become easy to be growth base point of titanium hydride. Incidentally, the twin existence ratio in the titanium crystal shown in FIG. 3 is about 35%.

TABLE 3

| Sample No. | Crystal grain size No. | Twin existence ratio (%) | Hydrogen content (ppm) Initial hydrogen content | Hydrogen content after electrolysis | Occurrence of pits |
|---|---|---|---|---|---|
| 1 | 6.0 | 33 | 20 | 36 | Observed |
| 2 | 6.1 | 26 | 19 | 34 | |
| 3 | 6.1 | 20 | 21 | 33 | Not |
| 4 | 6.0 | 15 | 19 | 32 | observed |
| 5 | 6.1 | 5 | 20 | 32 | |

Table 3 shows the results of the measurement of hydrogen contents in cathode electrodes made of titanium having crystal grain size and the initial hydrogen contents at the same levels and different in the twin existence ratio after the cathode electrodes are employed for practical manufacture of an electrodeposited copper foil for 2000 hours. In this case, titanium materials used have 6.0 to 6.1 of the crystal grain size number to find the effect of only the twin existence ratio. Then, the occurrence of pit generation is confirmed. As a result, in the region where the twin existence ratio is 20% or lower, no pit generation is observed and in the region where the twin existence ratio exceeds 20%, pit generation is confirmed. According to these facts, in order to suppress the formation of titanium hydride, the twin existence ratio has to be kept as low as possible and it is supposed to be necessary to keep the twin existence ratio 20% or lower.

Incidentally, the twin existence ratio in this description means a value calculated according to the equation 2 from the total crystal grain number (N) observed in the observation field and the number (Nt) of crystal grains regarded as twin.

$$\text{Twin existence ratio} = Nt/N \times 100(\%) \qquad \text{Equation 2}$$

The invention as claimed in claim 3 is a rotary cathode drum to be employed for manufacturing an electrodeposited copper foil comprising an inner drum equipped with rotatable supporting shafts and a cylindrical outer skin fitted in the outer circumferential face and the foregoing outer skin part is employed as a cathode electrode made of titanium for manufacturing an electrodeposited copper foil as recited in claim 1 or claim 2.

Figure 4:
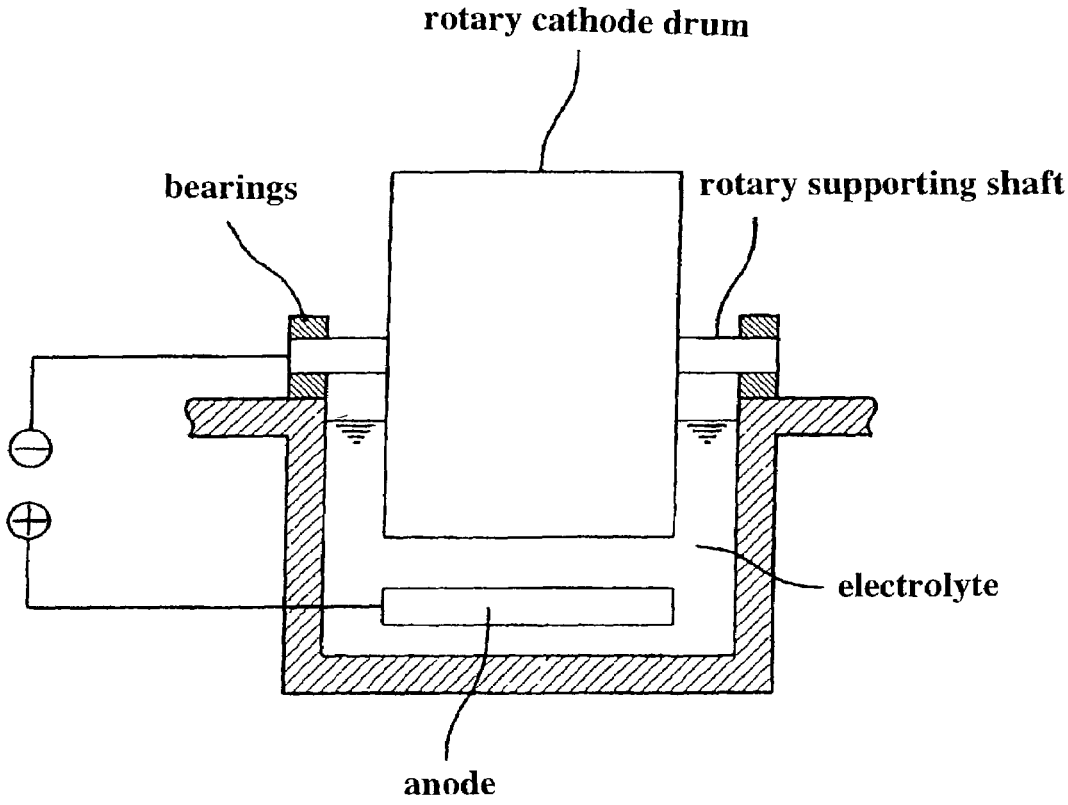
FIG. 4 shows a diagrammatic view of an electrolytic apparatus to be employed for manufacturing an electrodeposited copper foil.

A rotary cathode drum using a titanium material in the face where copper is electrodeposited is employed presently for manufacturing an electrodeposited copper foil. In the manufacture of an electrodeposited copper foil, as shown in FIG. 4, the rotary cathode drum is hung by rotary supporting shafts in the state the drum is partly immersed in an electrolyte in an electroforming cell and the lead type anode is positioned so as to be opposed to the shape of the titanium material to be copper deposition face of the rotary cathode drum. Between the electrodes, a copper sulfate solution is passed and copper is deposited on the surface of the titanium material of the rotary cathode drum by utilizing electrolytic reaction and the deposited copper becomes a foil-like state to be rolled up while being continuously peeled from the rotating cathode drum. The titanium material composing the cathode face of the rotary cathode drum is called as an outer skin material. In this specification, for convenience sake for explanation, it is sometimes referred as to an outer skin material or an outer skin part.

Figure 5:
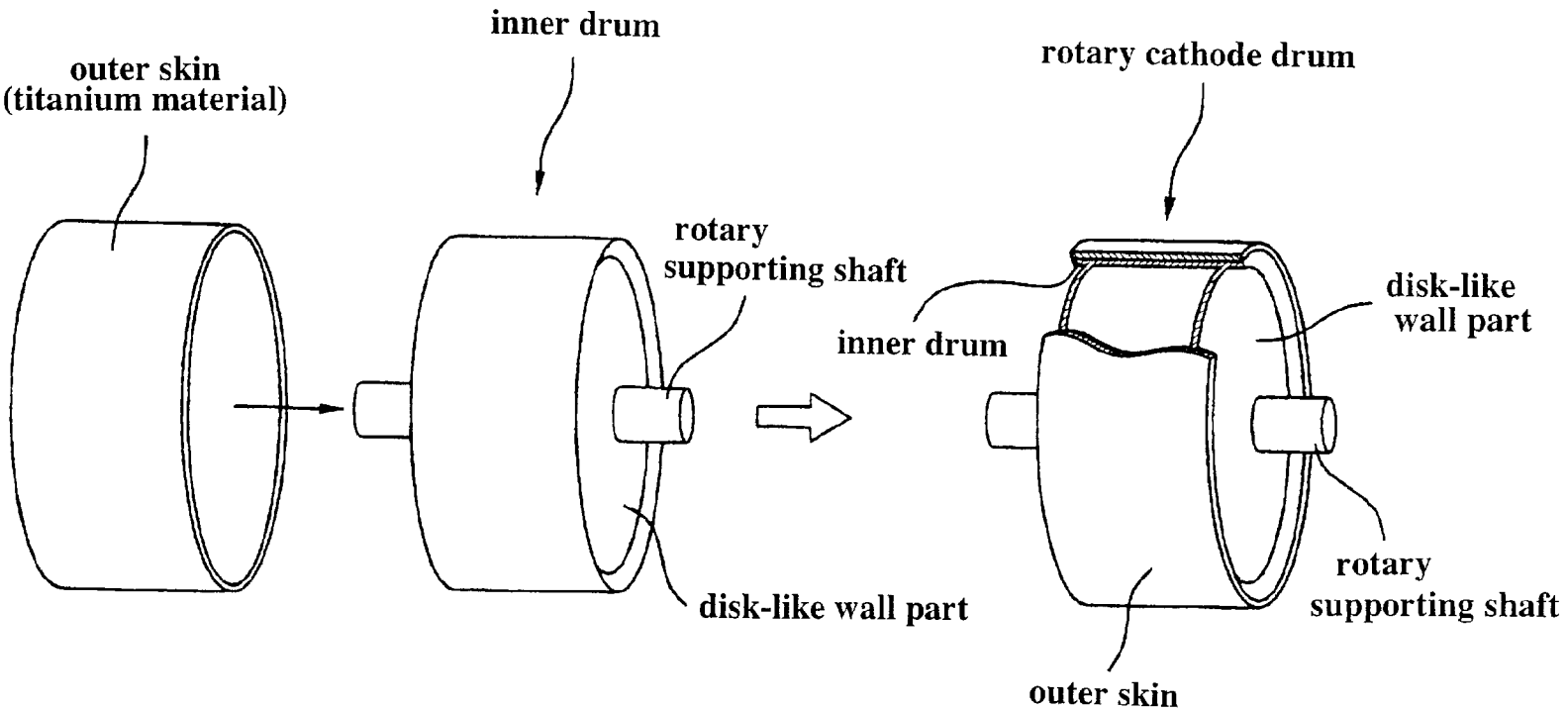
FIG. 5 is a schematic view of a rotary cathode drum.

To roughly explain the shape of the outer appearance of the rotary cathode drum observed, the rotary cathode drum can be explained as it comprises two disk-like wall parts, rotary supporting shafts to be connected to the center part of the disk-like wall parts, and the outer circumferential wall, the outer skin part. Actually, as shown in FIG. 5, it is manufactured by forming a stainless steel or a carbon steel in an inner drum with a drum-like shape and shrink-fitting an outer skin made to be cylindrical on the outer circumferential face of inner drum. Consequently, the disk-like wall parts are the circular faces of the inner drum appearing in the outer sides. FIG. 5 shows the inner constitution of the rotary cathode drum after shrink-fitting of the outer skin on the inner drum while some of the outer skin and the inner drum are omitted so as to make the constitution easy to be understood. As shown in FIG. 4, two rotary supporting shafts respectively rotate the rotary cathode drum and at the same time work as parts to be employed for the electric current supply passages for cathode polarization of the outer skin through the rotary supporting shafts while being mounted on bearings and hung over.

The rotary cathode drum as described in the claim 3 is a drum for which the cathode electrode made of titanium for manufacturing an electrodeposited copper foil as described in claim 1 and claim 2 is used as the material for composing the outer skin. That is, the outer skin to be employed for manufacturing a rotary cathode drum as described in claim 3 is the cathode electrode made of titanium for manufacturing an electrodeposited copper foil described in claim 1 and claim 2 and is manufactured by deformation-processing a plate-like material into a cylindrical shape and welding the end parts to each other to be finished as a cylindrical shape.

By forming into a rotary cathode drum as described above, the rotary cathode drum is cathode-polarized while being rotated and at the same time, a copper sulfate is electrolyzed to electrodeposit copper in a foil-like state on an outer skin made of a titanium material and the deposited copper is continuously rolled up to manufacture an electrodeposited copper foil. At that time, by using a titanium material similar to that employed for the cathode electrode made of titanium for manufacturing an electrodeposited copper foil as described in claim 1 and claim 2, it is made possible to continuously use a rotary cathode drum for manufacturing an electrodeposited copper foil for a long duration.

In order to make crystal grain size of a cathode electrode made of titanium as described above and at the same time to lower the hydrogen content, even at the time of manufacturing a titanium material to be employed for the electrode, there are a variety of points to pay attention especially in the manufacturing method. The points to be controlled for the cathode electrode made of titanium according to the present invention are three points; the crystal grain size, the hydrogen content, and the twin density. Consequently, the inventors of the invention to carry out manufacture by controlling these points achieve a manufacturing method as described below.

To manufacture a titanium plate to be a cathode electrode made of titanium according to the invention, to be short, based on the fact that the manufacture is carried out through rolling process of a titanium ingot and a variety of thermal treatments, the manufacture can be considered as follows.

The fact most affecting the adjustment of the crystal grain size in the manufacturing method is supposed to be the combination of the processing degree of the rolling process and the thermal treatments. That is, the adjustment of the crystal grain size of a titanium material is carried out by thermally treating the crystal structure which is deformed and in which dislocation density is increased by rolling process to eliminate dislocation, restore a proper structure by re-structuring, and cause recrystallization by further thermal treatment.

Taking general properties of a metal into consideration, since dislocation with a high density is included in a metal having a high reduction surface area ratio of the rolling process and a high processing degree, and the state in the crystal is unstable with high distortion energy, dislocation in a low temperature range is easy to be shifted and as a results the restoration is quickened and recrystallization is easy to be caused. As a result, in order to adjust the crystal grain size, it is inevitable to control the crystal grain size of a titanium material to be employed as a cathode electrode made of titanium, which is a final product has to be controlled depending on the combination of the processing degree of a titanium material in the rolling process and the thermal treatment conditions corresponding to the processing degree.

A titanium material has been known as a material easy to absorb hydrogen and easily absorb hydrogen from atmospheric air. Consequently, in the entire process, means of suppressing hydrogen absorption has to be employed so as to control the hydrogen absorption amount.

Further, twin formation is supposed to be carried out owing to the deformation generated in the process of a titanium material around a room temperature. That is, since the slide deformation in the c-axis, one of the crystal axes, is difficult regarding titanium, if deformation takes place at a temperature lower than the recrystallization temperature or lower, in the case of crystal grains parallel in the direction to the c-axis in which the deformation stress is applied, it is supposed that the deformation mechanism is not owing to the sliding but so-called twin deformation is caused to result in promotion of twin growth.

The invention includes a method for manufacturing a titanium material for manufacturing an electrodeposited copper foil as a manufacture method to obtain a titanium material by subjecting a pure titanium plate to hot rolling process obtain a rolled titanium plate and subjecting the rolled titanium plate to finishing thermal treatment and in the manufacturing method, the hot rolling process is carried out in rolling conditions; at not lower than 200° C. and lower than 550° C. of rolling starting temperature for a pure titanium plate and not lower than 200° C. of rolling finishing temperature and the reduction surface area ratio of 40% or more for the pure titanium plate to obtain a rolled titanium plate and the finishing thermal treatment of the rolled titanium plate is carried out while the ambient atmosphere in the inside of a thermal treatment furnace being controlled to be one of (1) the vacuum state with 1 kPa or lower; (2) the inert gas-exchanged state with a dewpoint of −50° C. or higher; and (3) the state of 2 to 5% of oxygen concentration and at 550 to 650° C. of finishing thermal treatment temperature for a finishing thermal treatment time defined as a calculation express of [the thickness (t) mm of the rolled titanium plate×10 (min)] or shorter. In order to use the titanium material for a cathode electrode as a cathode electrode made of titanium for manufacturing an electrodeposited copper foil according to the invention, the resulting titanium material is processed into a shape of a cathode electrode and naturally the surface in the shot state is smoothed or cleaned by grinding to use the titanium material. Consequently, those obtained by the method for manufacturing a titanium material as described in this specification are subjected to hydrogen content and crystal grain evaluation after the surface in about 1 mm depth being removed.

The reason why the conditions are controlled as not lower than 200° C. and lower than 550° C. of rolling starting temperature for a pure titanium plate and not lower than 200° C. of rolling finishing temperature and the reduction surface area ratio of 40% or more for the pure titanium plate is because rolling in cold mill promotes an immense amount of twin and it takes a long time or a temperature annealing work is required to completely remove the twin in the center part in the thickness direction of the processed material. Consequently, as long as such a phenomenon occurs, control of crystal grains becomes difficult and for that, rolling process in a hot mill is employed. In this case, the pure titanium means those classified as JIS H 4600 to be employed. Further, in this specification, hereinafter, the pure titanium plate after subjected to rolling process is called as "a rolled titanium plate" and the rolled titanium plate after subjected to finishing thermal treatment as "a titanium material for a cathode electrode".

The reason why the term, the rolling starting temperature, is employed is as follows. If a pure titanium plate heated to a prescribed temperature is processed by rolling rolls, the pure titanium plate is cooled by the rolling rolls to make the temperature of the pure titanium plate at the rolling starting differs from the rolling finishing temperature on completion of rolling and for that the term is employed to clarify the manufacturing conditions with the temperature of the pure titanium material at the starting of rolling and the temperature at the finishing of the rolling. Further, the heating of the pure titanium plate to a prescribed temperature before rolling (hereinafter referred as to "preheating") is carried out while employing the time defined as "the thickness of a pure titanium plate (mm)"×1.5 min/mm for the preheating time and preferably carried out at 750 to 850° C. The preheating is carried out for the purpose to remove the internal stress remaining in the pure titanium plate and to prevent twin generation at the time of rolling and it is required to be optimized in relation to the manufacture of a rolled titanium plate with a prescribed crystal grain size by rolling process at a reduction surface area ratio as described below.

The rolling process is carried out for mainly a purpose to control the plate thickness and the crystal grain size of a titanium material. Consequently, the effect to make the crystal grain fine in the rolling stage has to be achieved and heating in a temperature region in which recrystallization occurs in the middle of the rolling process is preferable to be avoided in consideration of crystal grain size control to be carried out finally. Owing to those described above, the rolling starting temperature is restricted to the temperature range at 200° C. or higher and not higher than 550° C. and the reduction surface area ratio is defined as described below. In the temperature range of lower than 200° C., although the effect to make the crystal grain fine is sufficiently satisfied, the stress remaining in the rolled titanium plate is high and the effect of the strain becomes significant to result in inferior plate shape. Further in the temperature range, the load of the rolling process becomes high, the damages of the rolling rolls become severe, uniform rolling state is hardly obtained and the crystal structure of a titanium material after rolling becomes uneven and therefore the temperature is defined not lower than 200° C. According to these, it may be judged that the temperature region of lower than 200° C. is not industrial valuable.

On the other hand, the temperature of 550 ° C. is a critical temperature at which whether recrystallization of a titanium material takes place or not and in the temperature range exceeding 550° C., recrystallization is caused in the middle of the rolling and the effect to make crystal grain size fine is hardly obtained to result in difficulty of the control of the crystal grain size to be 7.0 or higher to be desired. Especially, in the temperature range exceeding 650° C., the recrystallization speed becomes extremely high in this region and the crystal grain size becomes significantly big after the finishing thermal treatment, which will be described later. Although, only the rolling starting temperature is described above, the rolling finishing temperature is supposed to be same also and the rolling finishing temperature has to be 200° C. or higher. That the rolling finishing temperature becomes 200° C. or lower means that a pure titanium plate being subjected to the rolling becomes at 200° C. or lower in the middle of the rolling and it results in cancellation of the purpose of the regulation that the rolling starting temperature is 200° C. or higher.

Further, the reason why "the reduction surface area ratio is defined as 40% or higher" is because uniform rolling process becomes impossible to be carried out and the effect to make the crystal grain size fine for the purpose of the rolling process cannot evenly be achieved unless strengthening process of a certain level or more is performed. If the reduction surface area ratio is not satisfied as the reduction surface area ratio of 40% or higher on the bases of the surface area of an ingot state, the above described purpose cannot be achieved. The reduction surface area ratio, means the value calculated from [(h1−h2)/h1]×100% wherein h1 denotes the thickness of the material before rolling and h2 denotes the thickness of the material after rolling and it means that the higher the value is, the intenser, the processing is.

A titanium plate with a prescribed thickness obtained as described above is to be subjected finally to the finishing thermal treatment. The main purpose of the thermal treatment is to cause recrystallization to obtain an aimed crystal grain size by annealing the crystal structure of a titanium material which is deformed by rolling process and has processed structure. That is, the control of the crystal grain size of a rolled titanium plate is carried out depending on the combination of the rolling conditions and the finishing thermal treatment conditions which will be described below. However, here, in order to mainly confirm the effects of the rolling conditions and the ambient temperature in the finishing thermal treatment on the crystal grain size, the ambient atmosphere for the finishing thermal treatment is to be atmospheric to carry out heating and the crystal grain size number is measured. The results are shown in Table 4.

TABLE 4

| | Rolling conditions | | | | Finishing thermal treatment conditions | | Crystal grain size No. | | | |
|---|---|---|---|---|---|---|---|---|---|---|
| Sample No. | Material thickness (mm) | Rolling starting temperature (° C.) | Rolling finishing temperature (° C.) | Reduction surface area ratio (%) | Temperature (° C.) | Treatment time (min) | Immediately under surface | Center of thickness | Product characteristic | Evaluation results |
| 1 | 35 | 700 | 506 | 71 | 600 | 5 | 5.0 | 4.0 | | x |
| 2 | | 600 | 453 | | | | 6.5 | 6.0 | | |
| 3 | | 550 | 343 | | | | 7.5 | 7.0 | | ○ |
| 4 | | 500 | 272 | | | | 7.5 | 7.5 | | |
| 5 | | 450 | 215 | | | | 8.0 | 7.5 | | |
| 6 | | 400 | 188 | | | | 9.0 | 8.5 | Shape inferior | x |
| 7 | 20 | 550 | 323 | 50 | | | 8.0 | 7.5 | | ○ |
| 8 | 16 | | 312 | 38 | | | 7.0 | 6.0 | | x |
| 9 | 35 | 500 | 272 | 71 | 500 | | — | — | Un-recrystallized | |
| 10 | | | | | 550 | | 8.5 | 9.0 | | ○ |
| 11 | | | | | 650 | | 7.0 | 7.5 | | |
| 12 | | | | | 700 | | 5.5 | 6.0 | | x |
| 13 | | | | | 600 | 10 | 7.0 | 7.0 | | ○ |
| 14 | | | | | 550 | 15 | 6.0 | 6.5 | | x |

Material thickness: the thickness of a pure titanium plate

Evaluation result: ○ is marked to those having crystal grain size no. of 7.0 or higher and having no abnormality such as shape inferior or un-recrystallization and × is marked to those other than the materials described above.

As being understood from Table 4, the crystal grain size number of a rolled titanium plate in the case where the not to be 7.0 or higher, which is the aimed crystal grain size number. Further, the sample No. 6 of Table 4 shows the results of showing occurrence of warping impossible to be corrected in the rolled titanium plate at the time of finishing the finishing thermal treatment even though the condition of the crystal grain size number is satisfied. In the conditions for the sample No. 9 of Table 4, as described as un-recrystallized as the product characteristic, recrystallization is not caused owing to the insufficient heat supply in the finishing thermal treatment. Those are marked with × as industrially unusable ones even if the crystal grain size number is satisfactory. Pure titanium plates employed for the rolling process are of 120 mm width×200 mm length and with the thickness as described in Table 4 and such plates are rolled by rolling rolls to have 10 mm finishing thickness. The preheating before the starting of the rolling is carried out at 800° C. of an electric furnace and heating durability is controlled to satisfy [the thickness (mm) of a pure titanium plate×1.5 min/mm]. On completion of the preheating, each pure titanium plate is taken out the electric furnace and rolling is started when the temperature reaches the prescribed rolling starting temperature. On completion of the rolling, annealing is carried out in the finishing thermal treatment conditions as shown in Table 4. As the results shown in Table 4, a material with the most preferable crystal grain size can be manufactured with the ranges of the rolling process conditions defined in claim 4. Incidentally, in the Table 4 the crystal grain size number in the face appearing after cutting about 1 mm of the surface of a titanium material after the finishing thermal treatment is defined as the value "immediately under the surface" and the crystal grain size number in the center of a titanium material is displayed as a value of "the center of the thickness".

The problem in the annealing carried out in the finishing thermal treatment is attributed to a property of a titanium material heated generally in atmospheric air that an oxidation scale, which is a thick oxidation film, is formed on the surface and it promotes hydrogen absorption from the atmospheric air depending on the conditions.

Therefore, it becomes important in the finishing thermal treatment how control the annealing environment. Regarding the annealing atmosphere, according to the enthusiastic investigation which inventors of the invention have made, it is made clear that the most optimum for a titanium material to be employed for a cathode electrode is to control the atmosphere to be one of (1) the vacuum state with 1 kPa or lower; (2) the inert gas-exchanged state with a dewpoint of −50° C. or higher; and (3) the state of 2 to 5% of oxygen concentration.

Hereinafter, to described the above described three conditions, since the necessity of the control for the hydrogen content is described above, it is eliminated so as to avoid duplication of the description. Inventors of the invention reach-the-above described annealing atmosphere conditions as the method for suppressing the hydrogen absorption to the minimum limit in the annealing process for the recrystallization by forming a uniform, fine and proper oxidation film.

The reason of "(1) the vacuum state with 1 kPa or lower" is to lower the hydrogen absorption by preventing the unnecessary oxidation film formation to form a proper oxidation film by carrying out annealing in the atmosphere of so-called low vacuum state. Although in this case the vacuum condition is restricted to 1 kPa or lower, to be more strict, it is preferable to employ the vacuum degree of 0.01 kPa or lower. In the vacuum atmosphere of 0.01 kPa or lower, hydrogen is released from the surface of a titanium plate during heating, so that the hydrogen content after the thermal treatment is lowered. On the contrary, in the region of 0.01 kPa and near the atmospheric pressure, hydrogen absorption takes place from the remaining water or the like in the atmosphere to result in a high hydrogen content. However, it is sufficient to keep the hydrogen content at a level of 35 ppm in the invention and as a result of an enthusiastic investigation of vacuum degree to achieve the purpose, 1 kPa is found to have a significant critical meaning. Consequently, hydrogen absorption is easier to be caused as the pressure exceeds 1 kPa more and becomes closer to the atmospheric pressure and finally the hydrogen content in a cathode electrode made of titanium, a final product, exceeds 35 ppm.

Table 5 shows the results of the effect of the vacuum degree on the hydrogen content by manufacturing a rolled titanium plate in the rolling conditions of the case of the sample No. 4 shown in Table 4 and producing the ambient conditions with changed vacuum degrees. Those used for that case are rolled titanium plates with hydrogen content of 20 ppm. The finishing thermal treatment condition in Table 5 are controlled as that a sample of 30 mm square and 10 mm thickness is set in a vacuum heating furnace controlled to be a prescribed vacuum degree as described in Table 5 and that annealing is carried out at 600 ° C. ambient temperature for 5 minutes. On completion of annealing, heating is stopped and each sample is cooled in the furnace to a room temperature and then taken out. The surface of the resulting sample is removed to about 1 mm depth and the hydrogen content is measured using a hydrogen gas analyzer.

TABLE 5

| | Finishing thermal | Hydrogen content analysis result (ppm)* | | Hydrogen |
|---|---|---|---|---|
| Sample No. | treatment condition vacuum degree (kPa) | Total hydrogen amount | Absorbed hydrogen amount | content evaluation result** |
| 1 | 100 | 38 | 18 | x |
| 2 | 10 | 42 | 22 | |
| 3 | 1 | 30 | 10 | ○ |
| 4 | 0.1 | 26 | 6 | |
| 5 | 0.01 | 18 | −2 | |

As being understood from Table 5, in the case of the vacuum degree is 0.01 kPa, the decreased hydrogen content after the finishing thermal treatment is apparently understood. On the other hand, in the vacuum atmosphere of exceeding 1 kPa, the hydrogen content exceeds 35 ppm, proving the aim of this invention is valid.

The reason of (2) "the inert gas-exchanged state with a dewpoint of −50° C. or higher" is to prevent hydrogen absorption by exchanging the atmospheric air with an inert gas and promoting a proper oxidation film formation. Such a method is especially advantageous in the case where the hydrogen absorption is required to be suppressed to the minimum level. In this case, the inert gas with a dewpoint of −50° C. or higher means argon. In the case of using such an inert gas, although hydrogen is absorbed from water in the ambient atmosphere, oxygen simultaneously forms a protective oxidation film rapidly on the surface of a titanium material which is effective as a barrier against hydrogen penetration, so that hydrogen absorption is consequently prevented. On the other hand, if an inert gas with a dewpoint below −50 ° C. is used, the above described protective oxidation film cannot be formed, so that hydrogen easily penetrates a titanium material to result in increase of hydrogen absorption.

Table 6 shows the results of investigation carried out to examine the effect of the dewpoint on the hydrogen absorption using same sample as those used for Table 5 by producing an inert gas-exchanged atmosphere. Argon gas is used as the inert gas in this case. At the time of producing the argon gas-exchanged ambient environment, a rolled titanium plate is set in a vacuum heating furnace and the pressure is decreased to 1 kPa and then leakage of argon gas is slowly carried out until the pressure reaches the atmospheric pressure, and the water in the argon gas is controlled to change the dewpoint. Finishing thermal treatment is carried out in the same conditions as employed for the case of Table 5. On completion of annealing, heating is stopped and each sample is cooled to a room temperature in the furnace and then taken out. The surface of the resulting sample is removed to about 1 mm depth and the hydrogen content is measured using a hydrogen gas analyzer.

TABLE 6

| Sample No. | Finishing thermal treatment condition, inert gas dewpoint (° C.) | Hydrogen content analysis result (ppm)* Total hydrogen amount | Absorbed hydrogen amount | Hydrogen content evaluation result** |
|---|---|---|---|---|
| 1 | −70 | 45 | 25 | × |
| 2 | −58 | 38 | 18 | |
| 3 | −48 | 31 | 11 | ○ |
| 4 | −12 | 32 | 12 | |
| 5 | 10 | 30 | 10 | |

*Hydrogen content analysis result: the total hydrogen amount is the hydrogen amount contained in a rolled titanium plate at the moment of completion of finishing thermal treatment. The adsorbed hydrogen amount is the hydrogen amount calculated by substracting the hydrogen amount which a pure titanium plate originally contains from the beginning in a rolled titanium plate (in this case 20 ppm) from the total hydrogen amount.
**Hydrogen content evaluation result: the mark × is given in the case the total hydrogen content exceeds 35 ppm and the mark ○ is given in the case of 35 ppm or lower.

As being understood from Table 6, in the case where the dewpoint is −50° C. or higher, since the protective oxidation film is formed on the surface of a rolled titanium material, hydrogen absorption is suppressed and the absorption amount is found only slightly increased. On the contrary, if the dewpoint is lower than −50° C., hydrogen absorption amount is apparently increased and the results prove the above description is valid.

That (3) "the state of 2 to 5 vol. % of oxygen concentration" means the ambient atmosphere with decreased oxygen partial pressure in consideration of about 21 vol. % in the normal atmospheric oxygen concentration. If the oxygen concentration exceeds 5 vol. %, the oxidation film formation is easily caused by heating in the annealing temperature range, which will be described below, and although hydrogen absorption amount is slight, unnecessary oxidation scale formation easy takes place to result in considerable deterioration of the surface properties. On the other hand, the range of the oxygen concentration of less than 2 vol. %, oxidation film formation is insufficient by heating and no protective oxidation film which functions to prevent hydrogen absorption is formed and hydrogen absorption is made easy to result in increase of the hydrogen content. Especially, in the case where finishing thermal treatment is to be carried out by gas burner heating, hydrogen absorption from an un-burned gas also becomes a problem and thus the condition that the oxygen concentration is lower than 2 vol. % cannot be employed.

Table 7 shows the results of investigation of the effect of the oxygen content on the hydrogen absorption using samples same as those employed for Table 5 by producing the ambient environment with changed oxygen concentrations. In this case, using a gas burner heating furnace, the experiment is carried out by changing the oxygen partial pressure in the inside of the furnace by changing the air/fuel ratio. Annealing treatment is carried out in the same conditions employed for the case of Table 5. On the completion of the annealing, heating is stopped and each sample is cooled to a room temperature in the furnace and then taken out. The surface of the resulting sample is removed to about 1 mm depth and the hydrogen content is measured using a hydrogen gas analyzer.

TABLE 7

| Sample No. | Finishing thermal treatment condition, oxygen gas concentration (%) | Hydrogen content analysis result (ppm)* Total hydrogen amount | Absorbed hydrogen amount | Hydrogen content evaluation result** |
|---|---|---|---|---|
| 1 | 1.54 | 52 | 32 | × |
| 2 | 2.21 | 31 | 11 | ○ |
| 3 | 3.58 | 32 | 12 | |
| 4 | 4.85 | 30 | 10 | |
| 5 | 5.12 | 29 | 9 | ×; oxidation scale too large |

*Hydrogen content analysis result: the total hydrogen amount is the hydrogen amount contained in a rolled titanium plate at the moment of completion of finishing thermal treatment. The adsorbed hydrogen amount is the hydrogen amount calculated by subtracting the hydrogen amount which a pure titanium plate originally contains from the beginning in a rolled titanium plate (in this case 20 ppm) from the total hydrogen amount.
**Hydrogen content evaluation result: the mark × is given in the case the total hydrogen content exceeds 35 ppm and the mark ¢ is given in the case of 35 ppm or lower.

As being understood from Table 7, in the case where the oxygen concentration in the inside of the furnace is lower than 2 vol. %, since the protective oxidation film is not formed on the surface of a rolled titanium material, hydrogen absorption cannot be suppressed and the absorption amount is found increased. On the contrary, if the oxygen concentration exceeds 5 vol. %, the oxidation scale is grown to be big and the thickness of the surface required to be removed by grinding or the like increases to result in difficulty of practical use. Consequently, the oxygen concentration in a range of 2 to 5 vol. % as described above is the range with which the hydrogen absorption amount is most controllable in the optimum state.

The annealing temperature employed for the finishing thermal treatment is called as finishing thermal treatment temperature and a range of 550° C. to 650 ° C. is employed. The lower limit temperature, 550° C., for the finishing thermal treatment is the value essentially determined while being considered as the temperature of recrystallization of a titanium material. The upper limit value may be set to be 650° C. or higher, however the purpose is to control the crystal grain size and therefore if the temperature is the value at which the recrystallization is promoted so quickly, the crystal grains are easy to be roughened to make crystal grain size control difficult and to significantly affect surface oxidation film formation and hydrogen absorption by heating. Consequently, the range is led out as the range in which the control is made easy and annealing work can efficiently be carried out corresponding to the purposes of the invention.

Further, regarding the annealing time of the finishing thermal treatment, the time determined according to the calculation equation, [the thickness of a titanium plate (t) mm]×10 (min) is employed as the standard for the finishing thermal treatment time and the range is determined to be shorter than the value defined by the equation. In this case, no lower limit time is regulated. That is because the finishing treatment time is to be determined depending on the thickness (t) of a titanium material and it is so controlled as to finally adjust the crystal grain size number to be 7.0 or higher although the crystal states after rolling disperse to a prescribed extent among lots and the recrystallization speed also disperses among lots and therefore, the it is judged that the lower limit value is not necessarily required to be determined. If heating is carried out for a time exceeding the above described finishing thermal treatment time, crystal grains are grown and a titanium plate for a cathode electrode is produced with crystal grain size impossible to be employed for the invention.

A titanium plate for a cathode electrode produced as described above is provided with 7.0 or higher crystal grain size and 35 ppm or lower hydrogen content to be usable for a cathode electrode made of titanium for manufacturing an electrodeposited copper foil as described in claim 1 and claim 2. The titanium plate is used to produce an electrolytic drum for manufacturing of electrodeposited copper foil according to the claim 3.

Above all, in manufacture of a cathode electrode made of titanium for a manufacturing an electrodeposited copper foil with controlled existence ratio of twin in the crystal structure of 20% or lower, as described above, it is supposed that the possibility of twin appearance is high at the time of deformation of a titanium material and same results are observed as the results of the investigations which inventors of the invention have made so far. As described above, in the deformation of titanium, anisotropic crystal structure is accompanied with twin deformation and if the deformation temperature is increased higher than a room temperature, twin generation can be suppressed and consequently, it is made possible to suppress the increase of the twin density.

According to that, a manufacturing method includes a method of a correcting process to correct the shape of a titanium material obtained according to the manufacturing method of the invention to the desired shape and in the correcting process is characterized by correcting deformation of the titanium material in a temperature range of 50 ° C. to 200° C. as the method of the correcting process of a titanium material for a cathode electrode. "The correcting process" means the concept including the work for correcting the warped and twisted titanium material finished through the finishing thermal treatment to a flat one and the deformation process to adjust a titanium material to be an outer circumferential wall shape of an electrolytic drum to be employed for manufacturing an electrodeposited copper foil.

In this case, it is defined as that "a titanium material is corrected and deformed in a temperature range of 50° C. to 200° C." and that means a titanium material is corrected and deformed when the temperature becomes even in the titanium material itself and the temperature reaches equilibrium temperature, however it does not mean that a titanium material is simply put in the defined temperature range and corrected and deformed while the temperature difference being exist between the outside temperature and the inside temperature.

Table 8 shows the results of investigations of the effects of the heating temperature at the time of the correcting process on the twin generation. In this case, in order to eliminate the effect of the twin contained originally in a material to be considered, samples employed are rolled titanium plates of 500 mm width×1 m length×10 mm thickness rolled in the rolling conditions as the sample No. 4 in Table 5 and subjected to heating treatment at 650° C.×30 minutes before the correcting process to eliminate twin possible to be introduced by processing deformation.

TABLE 8

| Sample No. | Correcting process condition, heating temperature (° C.) | Twin generation ratio (%) | Occurrence of shape abnormality of product | Twin evaluation result |
|---|---|---|---|---|
| 1 | 30 | 40 | No abnormality | × |
| 2 | 40 | 28 | | |
| 3 | 50 | 18 | | ○ |
| 4 | 100 | 12 | | |
| 5 | 150 | 5 | | |
| 6 | 200 | 3 | | |
| 7 | 250 | 3 | Significant warping after correction | × |

Twin evaluation result: the evaluation mark × is given in the case the existence ratio of twin exceeds 20% and the evaluation mark ○ is given in the case the existence ratio of twin is 20% or lower.

The samples subjected to the heating treatment for removal of twin are heated and kept at the respective heating temperature shown in Table 8 for 30 minutes and subjected to correcting process by being passed through roller levelers. After that, 20 mm square sample pieces are samples from the rolled titanium after the correcting process and the surface of each sample piece is removed to about 1 mm depth and the resulting surface is etched to observe twin with 100 time magnification by an optical microscope in the same manner as described above.

As being understood from the results shown in Table 8, reason why "the ambient temperature is controlled to be 50° C. to 200° C." is because if the temperature is below 50° C., the twin density increase is so significant and it is impossible to control the existence ratio of twin in the crystal structure of a titanium material cannot be controlled to be 20% of lower as described in claim 2. On the other than, if heating at a temperature exceeding 200° C., although twin generation is scarce and the correcting process itself is easy, the release of the remaining stress after the correction takes place to result in generation of warping after correction and to make it impossible to achieve correction effect. Consequently, the above described temperature range is employed.

MODE FOR CARRYING OUT THE INVENTION

Hereinafter, the process of manufacturing a rotary cathode drum for an electrodeposited copper foil using a titanium material for a cathode electrode which is subjected to the rolling process, the finishing thermal process, and the correcting process will be shown as an embodiment and the results of continuously manufacturing an electrodeposited copper foil using the obtained rotary cathode drum will be described.

At first, the rolling process of a pure titanium plate will be described. A pure titanium plate of 1450 mm width×1600 mm length×45 mm thickness is heated at 700° C. in a heating furnace for 100 minutes and rolled at the reduction surface area ratio of 83% by a rolling apparatus at 500° C. rolling starting temperature. The rolling finishing temperature is 270° C. at that time. The hydrogen content contained originally in the pure titanium plate is 20 ppm.

The rolled titanium plate is set in a finishing thermal treatment furnace and heating by a gas burner is employed for the thermal treatment furnace and the ambient environment of oxygen content of 3 vol. % is produced by adjusting the air/fuel ratio of the gas burner and the finishing thermal treatment is carried out in conditions of 630° C. of the finishing thermal treatment temperature and for a finishing thermal treatment time of 40 minutes which is shorter than the time calculated as [the thickness (t mm) of the rolled titanium plate]×10 min/mm=7.5 mm×10=75 minutes. In such a manner, a plate-like titanium material for a cathode electrode to be employed for manufacturing an electrodeposited copper foil is obtained.

In the step on completion of the above described finishing thermal treatment, in order to correct strains generated in the plate-like titanium material for a cathode electrode and to obtain a flat plate-like state, the titanium material for a cathode electrode heated to 200 ° C. is subjected to correcting process by a roller leveler to obtain a flat plate-like material. After the correcting process, trimming is carried out to finish the rolled titanium plate of 1370 mm width× 8500 mm length×7.5 mm thickness. The titanium material for a cathode electrode obtained in this step has 7.5 of crystal grain size and 30 ppm of hydrogen content and 3% of twin existence ratio by 10-point crystal structure observation by changing the observation sites by an optical metal microscope.

Next, the process is carried out to make the titanium material for a cathode electrode be a cylindrical outer skin. To make the titanium material be cylindrical, the plate-like titanium material for a cathode electrode is bent and the end parts of the titanium material for a cathode electrode to be brought into contact with each other are welded. The welding time in this case is required to be carried out within a time as short as possible in order to suppress the change of the crystal grain size to the minimum level. For that, plasma welding, which is possible to be carried out within a short time, is employed.

Continuously, the resulting outer skin is heated to a prescribed temperature and shrink-fitted on a previously produced inner drum equipped with rotary supporting shafts with 2700 mm outer diameter of the outer circumferential wall face to fit and unite the outer skin and the inner drum and manufacture a rotary cathode drum for manufacturing an electrodeposited copper foil.

The effects of the above described rotary cathode drum will be described by comparison with the results in the case of actually using a rotary cathode drum to manufacture an electrodeposited copper foil which comprises an outer skin made of a conventionally used cathode electrode made of titanium having 5.8 of crystal grain size, 40 ppm of hydrogen content, and 25% of existence ratio of twin. Incidentally the method for observing the surface state of the rotary cathode drum is carried out as follows: a skilled worker observes the shiny side of an electrodeposited copper foil, which is a replica of the surface state of an outer case of a rotary cathode drum and specified the sites in the copper foil surface where projections exist and the sites are observed by a scanning electron microscope.

During the process of continuous use of the rotary cathode drum produced using the cathode electrode made of titanium according to the embodiment of the invention, the pit generation observed in the outer skin is 123 days after starting of the use and it is 197 days after when it is judges that the manufacture of an electrodeposited copper foil with 18 μm-nominal thickness is impossible. On the contrary to that, in the case of the conventionally used rotary cathode drum, pit generation takes place 65 days after and it is 98 days after when it is judges that the manufacture of an electrodeposited copper foil with 18 μm-nominal thickness is impossible. Based on the judgment from the above description, the rotary cathode drum using he cathode electrode made of titanium according to the embodiment of the invention can be said to be capable of continuously manufacturing an electrodeposited copper foil for an extremely long duration as compared with a conventional rotary cathode drum.

A titanium material for a cathode electrode obtained by a manufacturing method according to the present invention is used for a cathode electrode made of titanium for manufacturing an electrodeposited copper foil or used while being processed to be a rotary cathode drum, so that it can be made possible to manufacture an electrodeposited copper foil excellent in shape stability of a shiny side even after the cathode electrode or the rotary cathode drum is used continuously for manufacture of an electrodeposited copper foil for 3000 hours. In the case where a thin resist layer of such as a liquid resist is formed on a copper-laminated substrate without carrying out physical polishing as the surface adjustment treatment, wherein the copper-laminated substrate is manufactured using an electrodeposited copper foil produced in such as manner, since no abnormal precipitation part such as projections exists in the shiny side of the copper face, the resist layer can be formed evenly and the evenness of the exposure can be improved and consequently, out focusing of exposure can be avoided to make etching treatment of a fine pitch circuit easy.

What is claimed is:

1. A cathode electrode made of a titanium material to be employed for obtaining an electrodeposited copper foil using an electrolytic copper solution, wherein the titanium material has a crystal grain size number of no less than 7.0 and an initial hydrogen content of no greater than 35 ppm.

2. The cathode electrode according to claim 1, wherein the titanium material has an existence ratio of twin in the crystal structure of no greater than 20%.

3. A rotary cathode drum to be employed for manufacturing an electrodeposited copper foil comprising an inner drum equipped with rotary supporting shafts and a cylindrical outer skin part fitted on an outer circumferential face of the inner drum, wherein said outer skin part of the rotary cathode drum is the cathode electrode made of a titanium material as claimed in claim 1.

4. A method for manufacturing a titanium material suitable for use in the cathode electrode of claim 1, comprising the steps of: subjecting a titanium plate to a hot rolling process to form a rolled titanium plate and then subjecting the rolled titanium plate to a finishing thermal treatment, the hot rolling process comprising the steps of:

treating the pure titanium plate at a rolling starting temperature of no less than 200° C. and no greater than 550° C. and a rolling finishing temperature of no less than 200° C., and reducing the pure titanium plate to the rolled titanium plate at a reduction surface area ratio of no less than 40%:

wherein the finishing thermal treatment is carried out at a finishing thermal treatment temperature of from 550 to 650° C. in a thermal treatment furnace having an internal ambient atmosphere, wherein the internal ambient atmosphere of the thermal treatment furnace is controlled so as to be:

(1) a vacuum state with 1 kPa or lower vacuum, (2) an inert gas-exchanged state with a dew point of no less than −50°C., or (3) a state of 2 to 5% of oxygen concentration:

and wherein the finishing thermal treatment is carried out at a treatment time of no greater than a time, in minutes, defined by the thickness of the rolled titanium plate, in millimeters, multiplied by 10.

5. A method for converting the titanium material obtained according to the method of claim 4, into a desired shape, the method comprising the step of correcting and deforming the titanium material at a temperature range of from 50° C. to 200° C.

* * * * *